US011678107B2

(12) United States Patent
Zhou et al.

(10) Patent No.: US 11,678,107 B2
(45) Date of Patent: Jun. 13, 2023

(54) SPEAKER

(71) Applicant: AAC Microtech (Changzhou) Co., Ltd., Changzhou (CN)

(72) Inventors: Keyong Zhou, Shenzhen (CN); Xudong Yan, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 23 days.

(21) Appl. No.: 17/549,712

(22) Filed: Dec. 13, 2021

(65) Prior Publication Data

US 2022/0210542 A1 Jun. 30, 2022

(30) Foreign Application Priority Data

Dec. 28, 2020 (CN) ..... 202011575744.8

(51) Int. Cl.

| | |
|---|---|
| ***H04R 1/24*** | (2006.01) |
| ***H04R 7/12*** | (2006.01) |
| ***H04R 9/02*** | (2006.01) |
| ***H04R 9/04*** | (2006.01) |
| ***H04R 9/06*** | (2006.01) |

(52) U.S. Cl.

CPC ..... *H04R 1/24* (2013.01); *H04R 7/127* (2013.01); *H04R 9/025* (2013.01); *H04R 9/046* (2013.01); *H04R 9/06* (2013.01); *H04R 2400/11* (2013.01)

(58) Field of Classification Search

CPC ..... H04R 1/24; H04R 7/127; H04R 9/025; H04R 9/046; H04R 9/06; H04R 2400/11; H04R 2209/024; H04R 9/04

See application file for complete search history.

(56) References Cited

FOREIGN PATENT DOCUMENTS

CN 205283802 U * 6/2016

* cited by examiner

*Primary Examiner* — Angelica M McKinney

(74) *Attorney, Agent, or Firm* — W&G Law Group

(57) ABSTRACT

The present disclosure provides a speaker including a frame, a vibration system, and a magnetic circuit system, wherein the vibration system includes a first vibration diaphragm and a second vibration diaphragm which are fixed to two opposite sides of the frame, the magnetic circuit system includes a bobbin, a magnet fixed in the bobbin and spaced from an inner wall of the bobbin, a first pole plate fixed on one side of the magnet close to the first vibration diaphragm, a second pole plate fixed to one side of the magnet close to the second vibration diaphragm, and a third pole plate fixed outside the bobbin and spaced from an outer wall of the bobbin. The first voice coil assembly and the second voice coil assembly move inside and outside in a staggered manner, which saves a Z-directional space of the speaker and achieves higher magnetic field efficiency.

10 Claims, 10 Drawing Sheets

SPEAKER

TECHNICAL FIELD

The present invention relates to the technical field of electroacoustic conversion, in particular to a speaker.

BACKGROUND

In the vehicle-mounted speaker industry, a traditional cone speaker is generally used, at present, automobiles have higher requirements for high sound quality, flexible layout, low power consumption, and small vibration of horns (speakers).

The vehicle-mounted speaker of the related art includes a frame, a vibration system fixed to the frame, and a magnetic circuit system with a magnetic gap, wherein the magnetic circuit system drives the vibration system to vibrate and produce sounds, the vibration system includes a vibration diaphragm fixed to the frame, and a voice coil assembly which is fixed to the vibration diaphragm and inserted into the magnetic gap to drive the vibration diaphragm to vibrate and produce sounds. However, this speaker has the problems of large structural size, low efficiency, and great low-frequency vibration.

SUMMARY

The present invention aims to provide a speaker for improving the magnetic field efficiency.

In order to achieve the above objective, the present invention provides a speaker comprising a frame, a vibration system fixed to the frame, and a magnetic circuit system with a magnetic gap, wherein the vibration system comprises a first vibration diaphragm and a second vibration diaphragm which are fixed to two opposite sides of the frame.

The magnetic circuit system comprises a bobbin which is opened along a vibration direction of the vibration system, a magnet fixed in the bobbin and spaced from an inner wall of the bobbin, a first pole plate fixed on one side of the magnet close to the first vibration diaphragm, a second pole plate fixed to one side of the magnet close to the second vibration diaphragm, and a third pole plate fixed outside the bobbin and spaced from an outer wall of the bobbin; and the first pole plate and the third pole plate form a magnetic bowl through the bobbin.

The magnetic gap comprises a first magnetic gap formed by the first pole plate and the third pole plate, and a second magnetic gap formed by the second pole plate and the third pole plate.

The vibration system further comprises a first voice coil assembly inserted into the magnetic gap to drive the first vibration diaphragm to vibrate and produce sounds, and a second voice coil assembly inserted into the magnetic gap to drive the second vibration diaphragm to vibrate and produce sounds.

Preferably, the bobbin comprises a bobbin bottom wall sleeved on an outer circumferential edge of the second pole plate in a spacing manner, a bobbin side wall extending in a bent manner from an inner circumferential edge of the bobbin bottom wall towards the first vibration diaphragm, and a bobbin extending wall which extends in a bent manner from the bobbin side wall towards a direction close to the first pole plate and is parallel to the bobbin bottom wall; and the bobbin extending wall is fixed to one side of the magnet close to the first vibration diaphragm.

Preferably, the third pole plate comprises a third pole plate side wall sleeved on the outer side of the bobbin side wall, and a third pole plate bottom wall which extends in a bent manner from the third pole plate side wall towards a direction close to the second pole plate and is parallel to the bobbin bottom wall; and the third pole plate bottom wall is fixed to the bobbin bottom wall.

Preferably, the bobbin extending arm is fixed to the magnet, the third pole plate bottom wall, and the bobbin bottom wall in a glued, riveted, or welded manner.

Preferably, the bobbin is made of a magnetically non-conducting material.

Preferably, the frame comprises a first frame for fixing the first vibration diaphragm and a second frame for fixing the second vibration diaphragm; the first frame is stacked on the second frame along a vibration direction of the vibration system; a mounting part is convexly arranged on one side of the first frame facing the second frame; an avoiding part matched with the mounting part is sunken in a position corresponding to the mounting part on the second frame; or, a mounting part is convexly arranged on one side of the second frame facing the first frame; and an avoiding part matched with the mounting part is sunken in a position corresponding to the mounting part on the first frame.

Preferably, the first frame comprises a frame body, a supporting part spaced from the frame body, and a plurality of frame extending arms extending from the frame body to the supporting part; a through hole that runs through the supporting part and fixes the magnetic circuit system is formed in the supporting part along the vibration direction; or, the second frame comprises a frame body, a supporting part spaced from the frame body, and a plurality of frame extending arms extending from the frame body to the supporting part; and a through hole that runs through the supporting part and fixes the magnetic circuit system is formed in the supporting part along the vibration direction.

Preferably, the first voice coil assembly comprises a first voice coil bobbin fixed to the first vibration diaphragm and a first voice coil wound on the first voice coil bobbin; the first voice coil is at least partially located in the first magnetic gap; the second voice coil assembly comprises a second voice coil bobbin fixed to the second vibration diaphragm and a second voice coil wound on the second voice coil bobbin; and the second voice coil is at least partially located in the second magnetic gap.

Preferably, the first voice coil bobbin further comprises a first leakage hole running through the first voice coil bobbin, and the second voice coil bobbin further comprises a second leakage hole running through the second voice coil bobbin.

Preferably, the first vibration diaphragm comprises a first dome located in the center, a first curved ring which surrounds the first dome and is fixed to the frame, and a first dome connecting wall formed by extending from the first dome towards the first voice coil assembly; the second vibration diaphragm comprises a second dome located in the center, a second curved ring which surrounds the second dome and is fixed to the frame, and a second dome connecting wall formed by extending from the second dome towards the second voice coil assembly; the first dome and the first dome connecting wall, and the second dome and the second dome connecting wall are integrated respectively;

the vibration system further comprises a first elastic wave assembly and a second elastic wave assembly which are fixed to the frame and are spaced from each other; one end of the first elastic wave assembly away from the frame is connected to the first dome connecting wall; one end of the second elastic wave assembly away from the frame is connected to the second dome connecting wall; and the first elastic wave assembly and the second elastic wave assembly are in staggered distribution and have antiphase vibration.

The present invention has the beneficial effects: the speaker is provided, wherein the single magnet passes through the first pole plate, the third pole plate, and the second pole plate to form a closed magnetic field, thus forming the first magnetic gap and the second magnetic gap on the inner and outer sides of the bobbin. When under the same current, drive forces on the first voice coil assembly and the second voice coil assembly are the same, i.e., upper and lower BLs are the same. The first voice coil assembly and the second voice coil assembly move inside and outside in a staggered manner, which saves a Z-directional space of the speaker and achieves higher magnetic field efficiency.

DETAILED DESCRIPTION OF THE EMBODIMENTS

The present invention is further described below in combination with the accompanying drawings and embodiments.

It should be noted that all directional indications (such as up, down, left, right, front, rear, inner, outer, top, bottom, . . . ) in the embodiments of the present invention are only used for explaining relative position relationships between all components at a certain specific attitude (as shown in the figures). If this specific position changes, the directional indication also correspondingly changes with it.

Referring to FIG. 1 to FIG. 10, a speaker provided by the embodiments of the present invention is illustrated, which includes a frame 10, a vibration system 20, and a magnetic circuit system 30 with a magnetic gap. In particular, the magnetic circuit system 30 is configured for driving the vibration system 20 to vibrate and produce sounds. The frame 10 is configured for fixing the vibration system 20 and the magnetic circuit system 30.

Figure 1:
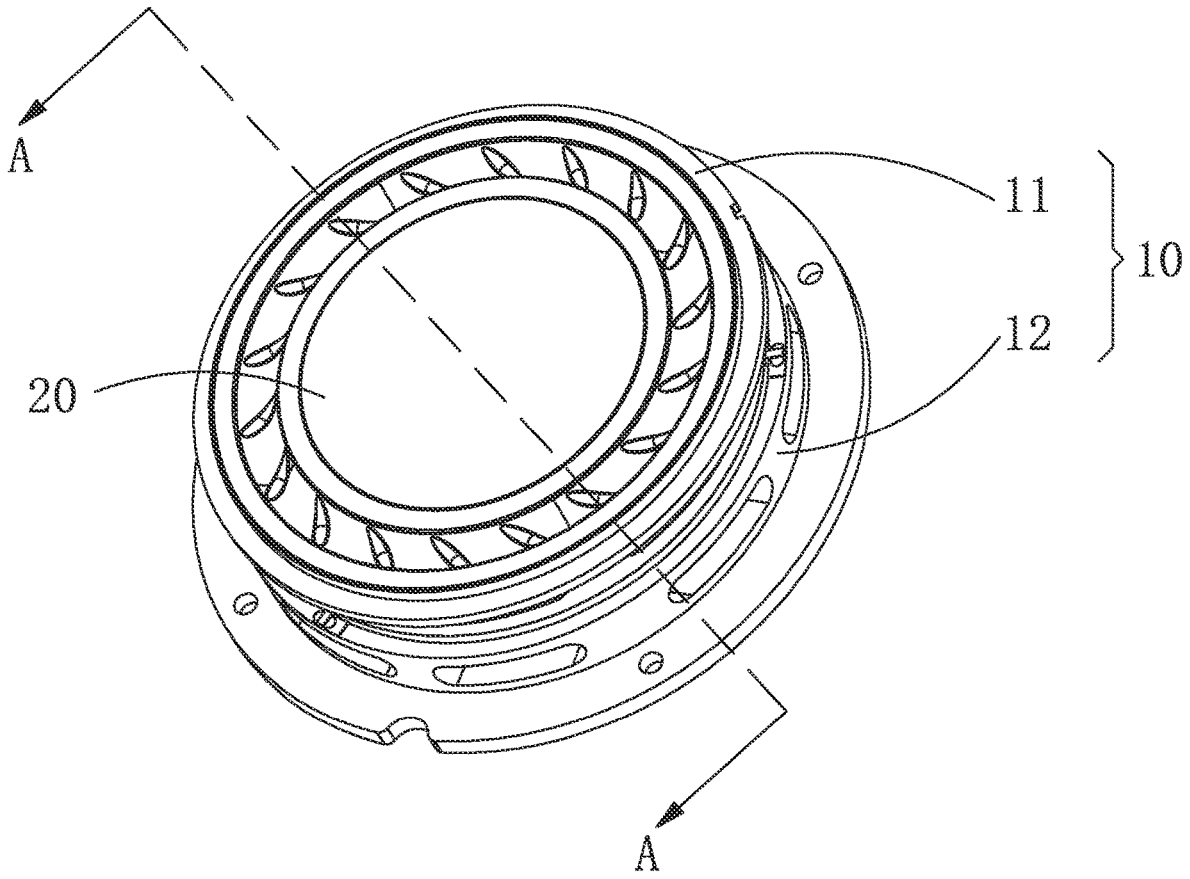
FIG. 1 is a schematic diagram of a three-dimensional structure of a speaker provided by the present invention.
Figure 2:
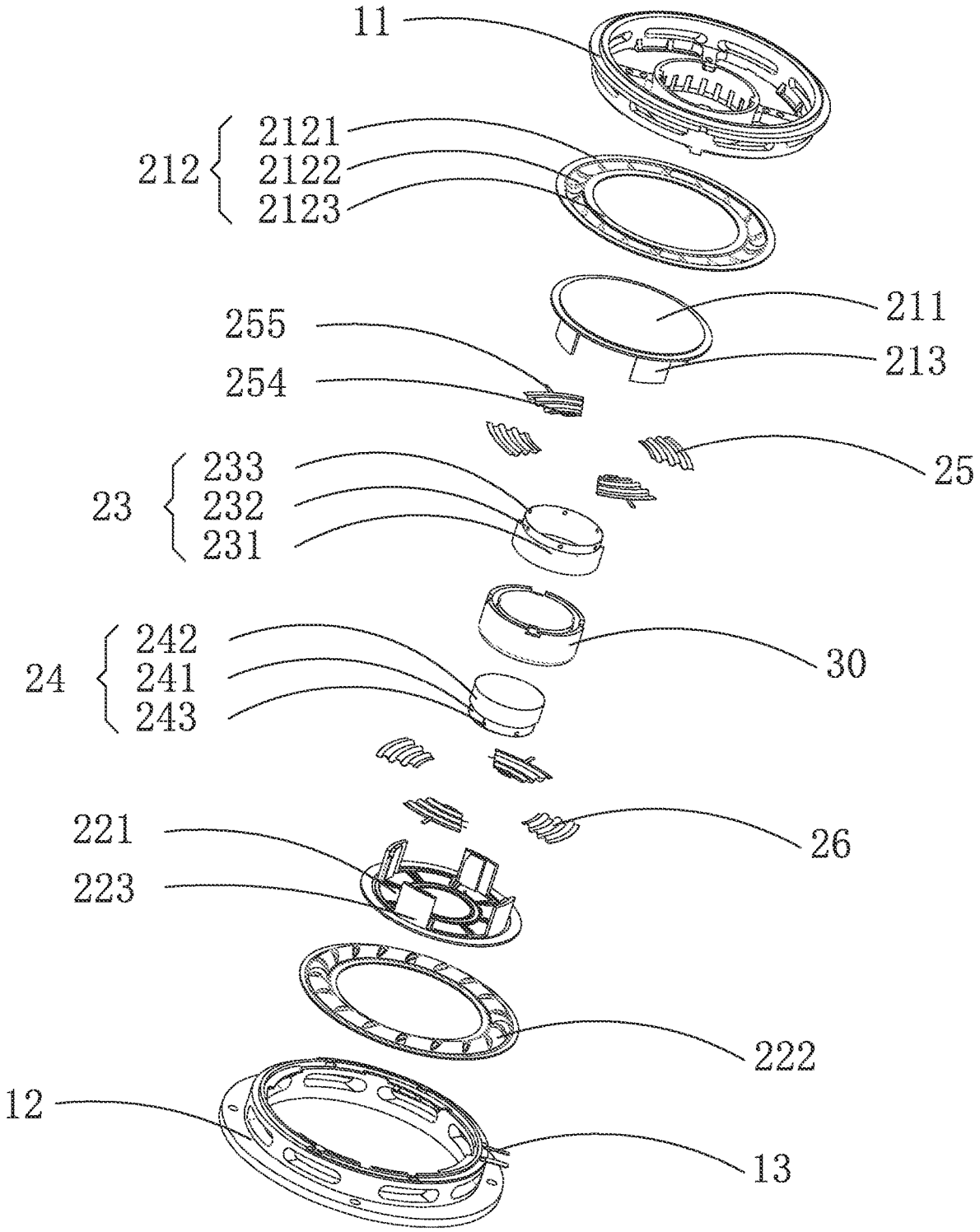
FIG. 2 is a schematic diagram of an exploded three-dimensional structure of a speaker provided by the present invention.
Figure 3:
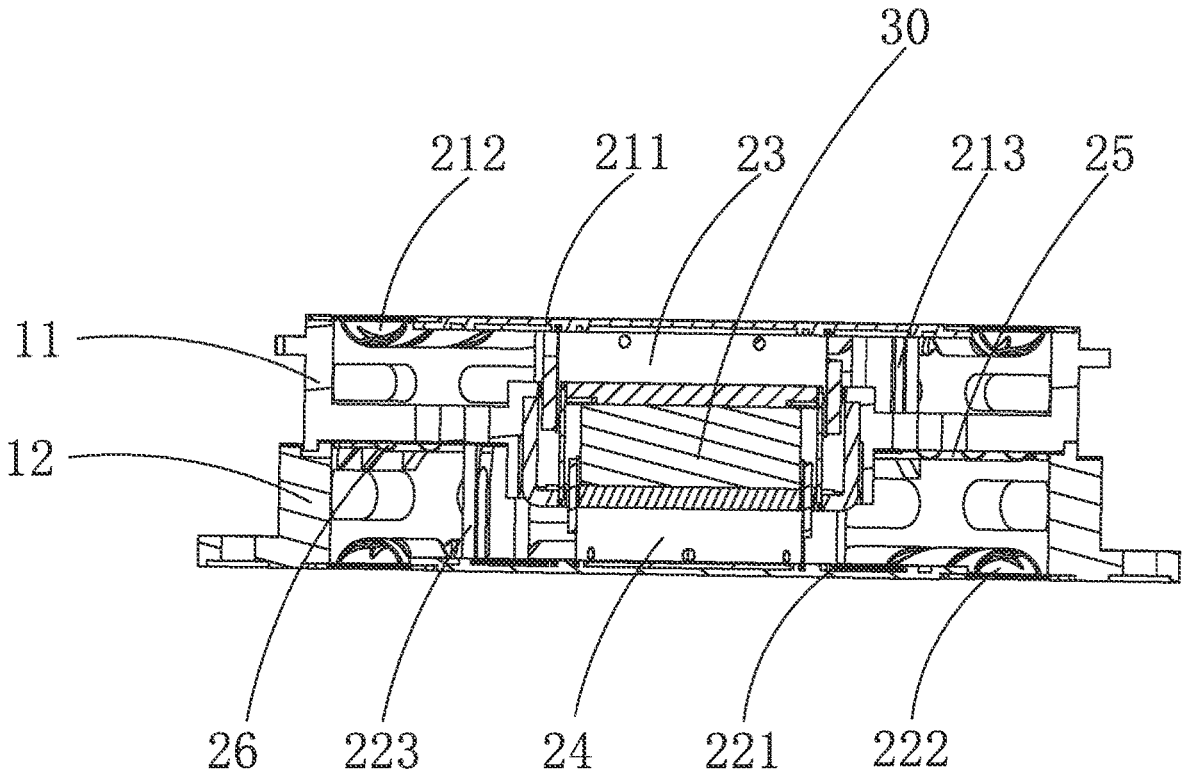
FIG. 3 is a cutaway view of FIG. 1 along the A-A direction.
Figure 4:
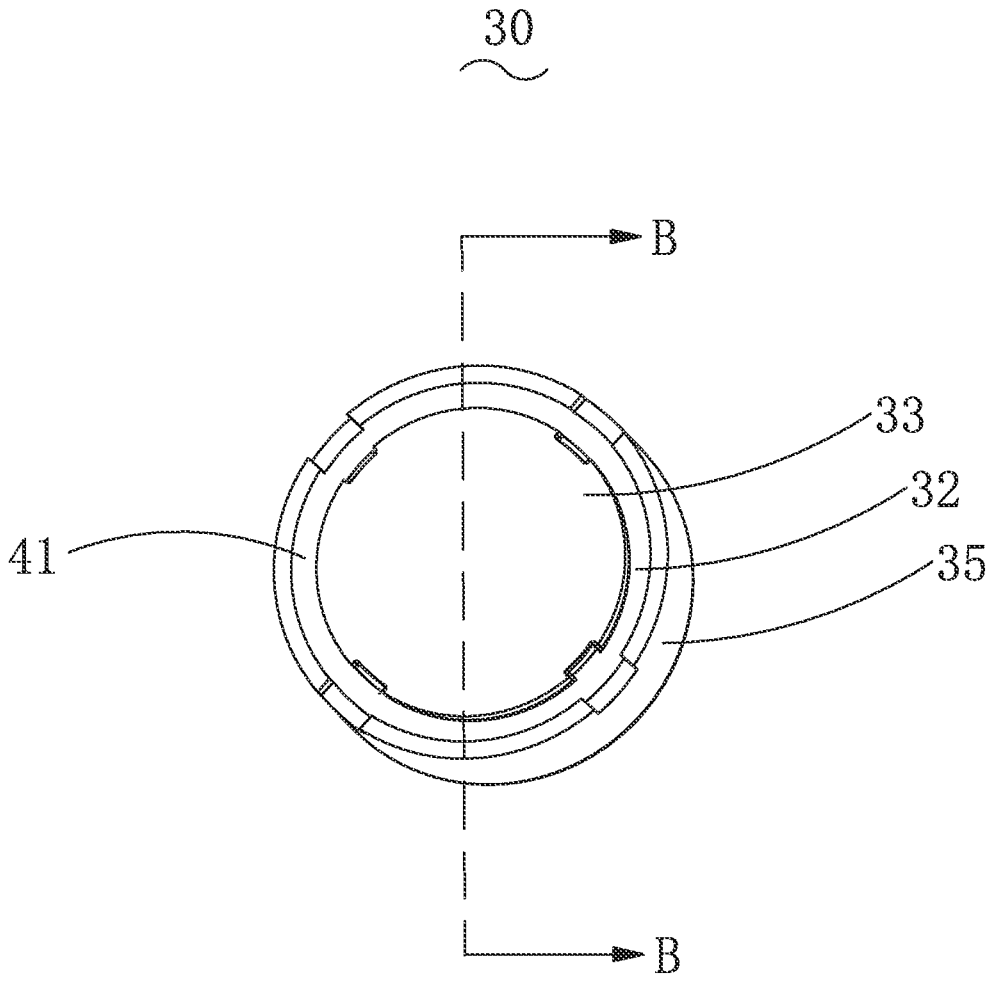
FIG. 4 is a schematic structural diagram of a magnetic circuit system provided by the present invention.
Figure 5:
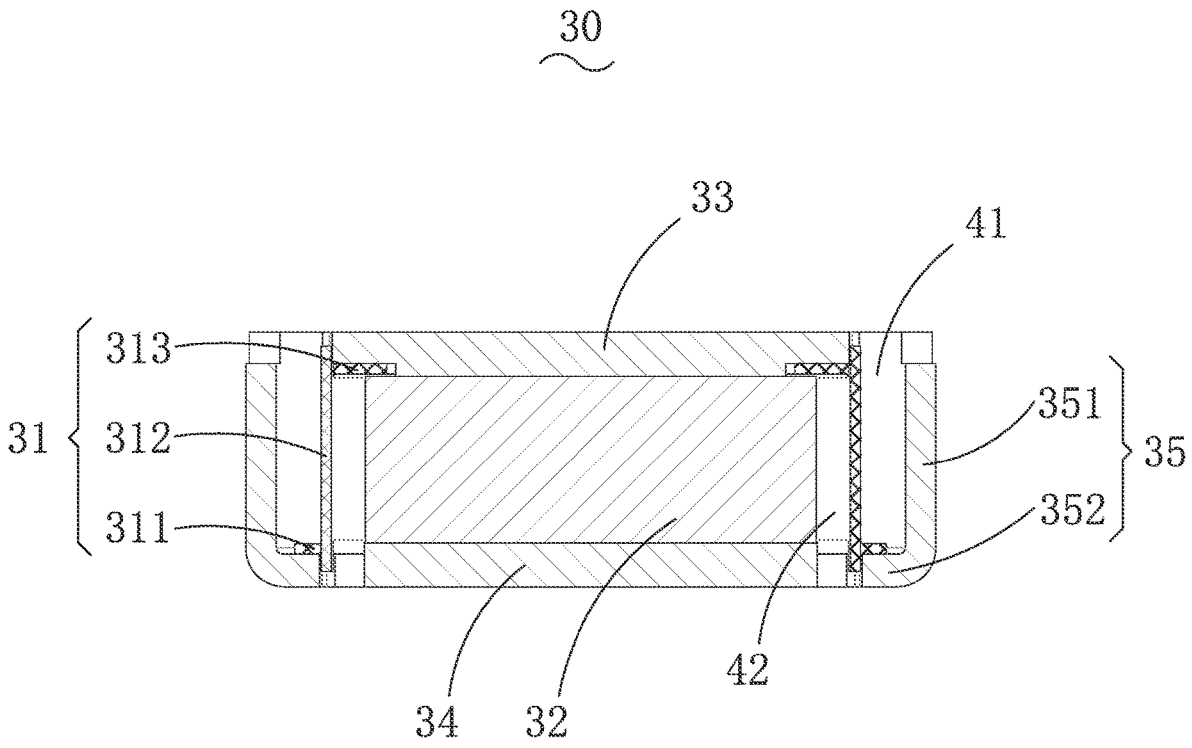
FIG. 5 is a cutaway view of FIG. 4 along the B-B direction.
Figure 6:
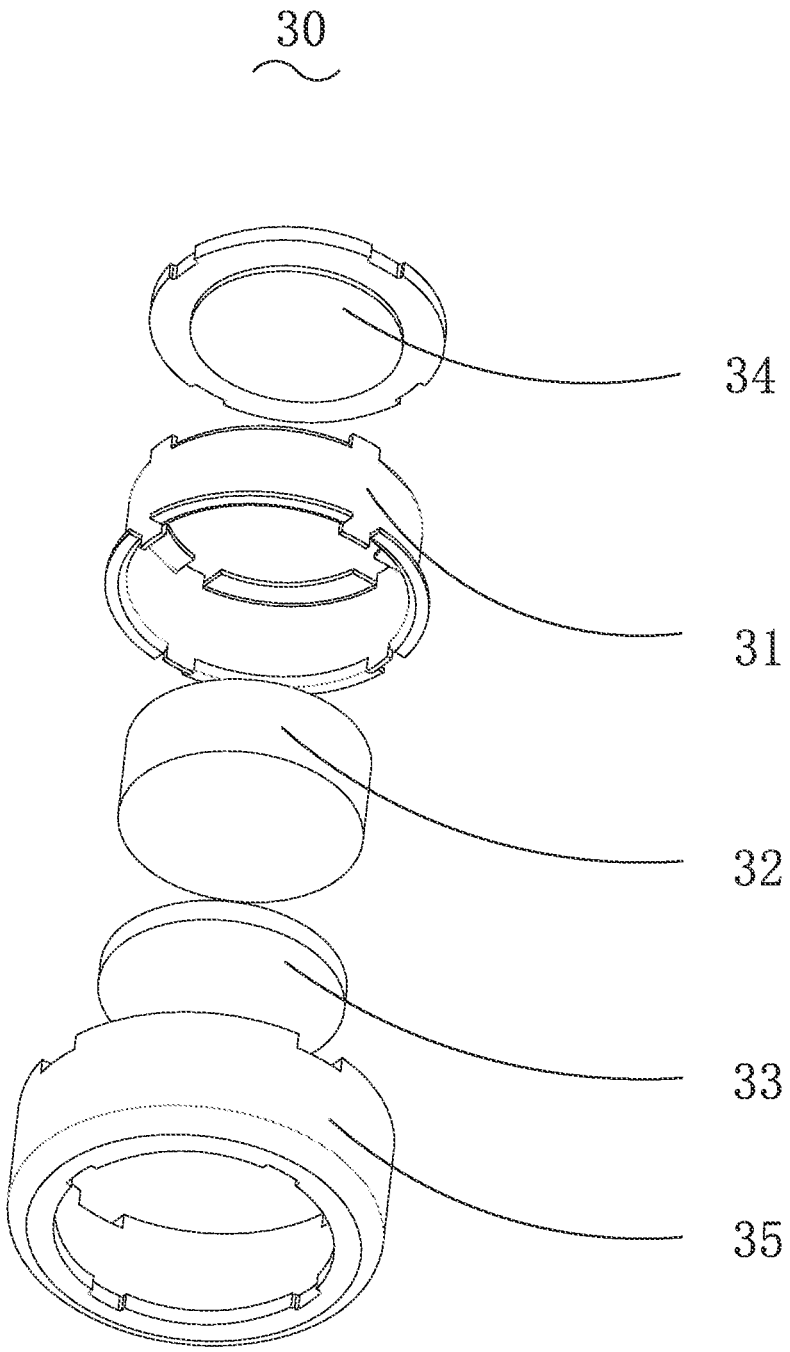
FIG. 6 is a schematic diagram of an exploded three-dimensional structure of a magnetic circuit system provided by the present invention.

Referring to FIG. 1 to FIG. 3, the vibration system 20 includes a first vibration diaphragm 21 and a second vibration diaphragm 22 which are respectively fixed on two opposite sides of the frame 10, and the magnetic circuit system 30 is located between the first vibration diaphragm 21 and the second vibration diaphragm 22. In the speaker of the present invention, the first vibration diaphragm 21 and the second vibration diaphragm 22 on the two opposite sides are configured for producing sounds in a radiated manner. The vibration directions of the first vibration diaphragm 21 and the second vibration diaphragm 22 are opposite. Since a drive force provided by the magnetic circuit system 30 is the same, the vibration of the speaker can be offset.

Referring to FIG. 2 to FIG. 6, the magnetic circuit system 30 includes a bobbin 31 which is opened along the vibration direction of the vibration system 20, a magnet 32 fixed in the bobbin 31 and spaced from an inner wall of the bobbin 31, a first pole plate 33 fixed on one side of the magnet 32 close to the first vibration diaphragm 21, the second pole plate 34 fixed to one side of the magnet 32 close to the second vibration diaphragm 22, and the third pole plate 35 fixed outside the bobbin and spaced from an outer wall of the bobbin 31; and the first pole plate 33 and the third pole plate 35 form a magnetic bowl through the bobbin 31.

That is, the first pole plate 33 is stacked on a surface of one side of the magnet 32 close to the first vibration diaphragm 21, and the second pole plate 34 is stacked on a surface of one side of the magnet 32 close to the second vibration diaphragm 22.

The magnetic circuit system 30 provides a magnetic field through the magnet 32, and a closed magnetic field is formed via the first pole plate 33, the third pole plate 35, and the second pole plate 34, wherein the first pole plate 33 and the third pole plate 35 form the first magnetic gap 41, and the second pole plate 34 and the third pole plate 35 form the second magnetic gap 42. The second magnetic gap 42 and the first magnetic gap 41 are formed on the inner and outer sides of the bobbin 31.

The vibration system further includes a first voice coil assembly 23 inserted into the first magnetic gap 41 to drive the first vibration diaphragm 21 to vibrate and produce sounds, and a second voice coil assembly 24 inserted into the second magnetic gap 42 to drive the second vibration diaphragm 22 to vibrate and produce sounds.

In the speaker provided by the embodiments of the present invention, the single magnet passes through the first pole plate 33, the third pole plate 35, and the second pole plate 34 to form a closed magnetic field, thus forming the first magnetic gap 41 and the second magnetic gap 42 on the inner and outer sides of the bobbin 31. When under the same current, drive forces on the first voice coil assembly 23 and the second voice coil assembly 24 are the same, i.e., upper and lower BLs are the same. The first voice coil assembly 23 and the second voice coil assembly 24 move inside and outside in a staggered manner, which saves a Z-directional space of the speaker and achieves higher magnetic field efficiency.

Further, the bobbin 31 includes a bobbin bottom wall 311 sleeved on an outer circumferential edge of the second pole plate 34 in a spacing manner, a bobbin side wall 312 extending in a bent manner from an inner circumferential edge of the bobbin bottom wall 311 towards the first vibration diaphragm 21, and a bobbin extending arm 313 which extends in a bent manner from the bobbin side wall 312 towards a direction close to the first pole plate 32 and is parallel to the bobbin bottom wall 311; and the bobbin extending arm 313 is fixed to one side of the magnet 32 close to the first vibration diaphragm 21. Further, the bobbin is made of a magnetically non-conducting material, which may specifically be aluminum, copper, plastic, etc.

The third pole plate 35 includes a third pole plate side wall 351 sleeved on the outer side of the bobbin side wall 312, and a third pole plate bottom wall 352 which extends in a bent manner from the third pole plate side wall 351 towards a direction close to the second pole plate 34 and is parallel to the bobbin bottom wall 311; and the third pole plate bottom wall 352 is fixed to the bobbin bottom wall 311.

Preferably, the bobbin extending arm 313 is fixed to the magnet 32, the third pole plate bottom wall 352, and the bobbin bottom wall 311 in a glued, riveted, or welded manner.

In the present embodiment, the first vibration diaphragm 21 includes a first dome 211 located in the center, a first curved ring 212 which surrounds the first dome 211 and is fixed to the frame 10, and a first dome connecting wall 213 formed by extending from the first dome 211 towards the first voice coil assembly 23; and the first dome 211 and the first dome connecting wall 213 are integrated.

The second vibration diaphragm 22 includes a second dome 221 located in the center, a second curved ring 222 which surrounds the second dome 221 and is fixed to the frame 10, and a second dome connecting wall 223 formed by extending from the second dome 221 towards the first voice coil assembly 24; and the second dome 221 and the second dome connecting wall 223 are integrated.

The first dome 211 and the first dome connecting wall 213, and the second dome 221 and the second dome connecting wall 223 are injection-molded. The curved rings and elastic waves are connected, so that the vibration system 20 has better vibration balance.

The vibration system 20 further includes a first elastic wave assembly 25 and a second elastic wave assembly 26 which are fixed to the frame 10 and are spaced from each other; one end of the first elastic wave assembly 25 away from the frame 10 is connected to the first dome connecting wall 213; one end of the second elastic wave assembly 26 away from the frame 10 is connected to the second dome connecting wall 223; and the first elastic wave assembly 25 and the second elastic wave assembly 26 are in staggered distribution and have antiphase vibration.

In this embodiment, the first elastic wave assembly 25 and the second elastic wave assembly 26 are in staggered distribution and have antiphase vibration. By this structure, the first elastic wave assembly 25 and the second elastic wave assembly 26 make reasonable use of an internal space of the speaker, the height of the speaker is reduced, and thinning development is facilitated. Meanwhile, a double-vibration-diaphragm effective vibration area is realized, the vibration loudness of the speaker is improved to a large extent, and the acoustic performance is improved.

Referring to FIG. 1 to FIG. 3, the frame 10 includes a first frame 11, and a second frame 12 stacked and fixed to the first frame 11 along the vibration direction of the vibration system 20. The first frame 11 fixes the first vibration diaphragm 21, and the second frame 12 fixes the second vibration diaphragm 22.

Figure 7:
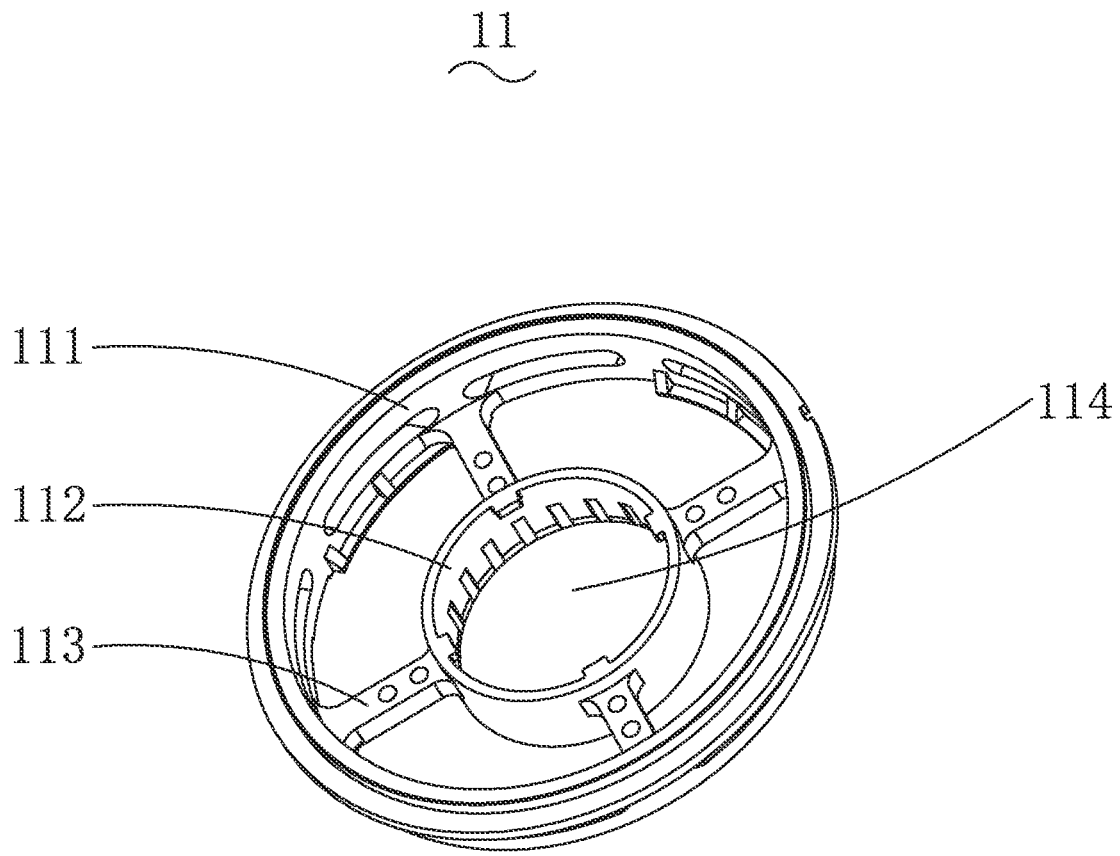
FIG. 7 is a schematic structural diagram of a first frame provided by the present invention.
Figure 8:
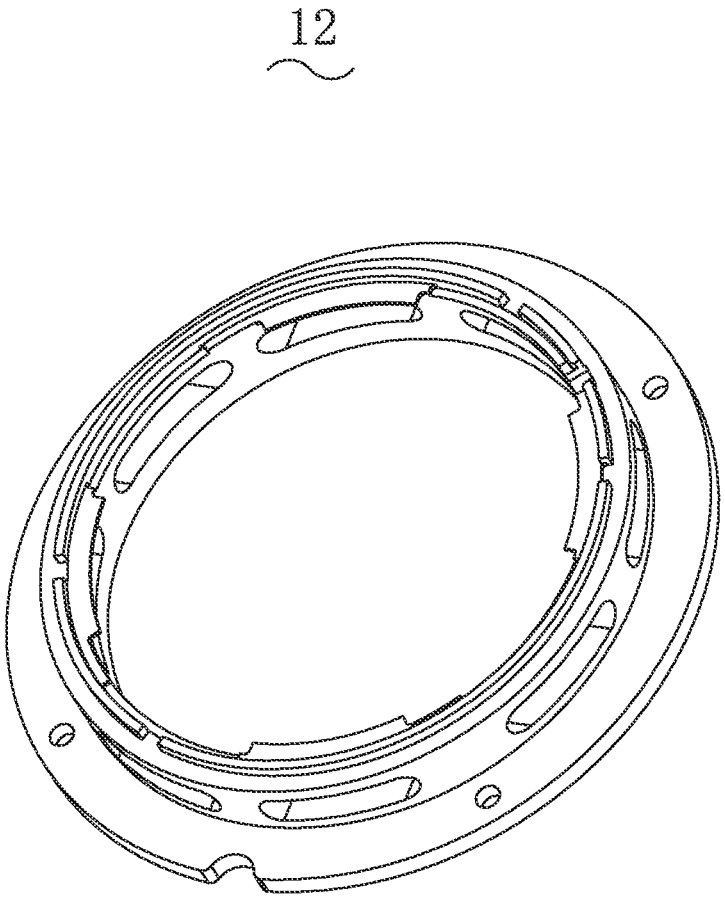
FIG. 8 is a schematic structural diagram of a second frame provided by the present invention.

Specifically, referring to FIG. 7, the first frame 11 includes a frame body 111 for fixing the first vibration diaphragm 21, a supporting part 112 spaced from the frame body 111, and several frame extending arms 113 extending from the frame body 111 to the supporting part 112; and a through hole 114 that runs through the supporting part 112 and fixes the magnetic circuit system 30 is formed in the supporting part 112 along the vibration direction. Specifically, the magnetic circuit system 30 is fixed in the through hole 114 through the third pole plate 35. Similarly, in other embodiments, the second frame 12 is provided with the above structures to fix the magnetic circuit system 30. That is, the second frame 12 includes a frame body, a supporting part spaced from the frame body, and several frame extending arms extending from the frame body to the supporting part; and a through hole that runs through the supporting part and fixes the magnetic circuit system is formed in the supporting part along the vibration direction.

In a production and assembling process, by the first frame 11 and the second frame 12, after components of the vibration system 20 and the magnetic circuit system 30 are assembled, the vibration system and the magnetic circuit system are then fixed by a mortise and tenon joint structure or gluing, thus stacking and forming one complete frame 10. This structure is favorable for saving assembling procedures and compressing the overall space of the speaker. Furthermore, this structure improves the fixing strength of the magnetic circuit system 30 and improves the reliability of the speaker.

A mounting part is convexly arranged on one side of the first frame 11 facing the second frame 12; an avoiding part matched with the mounting part is sunken in a position, corresponding to the mounting part, on the second frame 12. Similarly, in other embodiments, a mounting part is convexly arranged on one side of the second frame 12 facing the first frame 11; and an avoiding part matched with the mounting part is sunken in a position, corresponding to the mounting part, on the first frame 11.

The mounting part and the avoiding part on the first frame 11 and the second frame 12 are configured to realize their snap-in connection and horizontal positioning, so that a space required for combined connection between and horizontal positioning of the first frame and the second frame can be reduced. A larger accommodating space is provided for internal elements of the speaker, the thickness of the overall speaker is reduced, and the speaker is developed towards miniaturization.

Air vents are formed in a side wall of the first frame 11 and a side wall of the second frame 12.

Each first elastic wave assembly 25 includes a first elastic wave fixing part 251, a first elastic wave edge part 252, and a first elastic wave connection part 253 for connecting the first elastic wave fixing part 251 with the first elastic wave edge part 252; the first elastic wave fixing part 251 is fixed on the first frame 11; and the first elastic wave edge part 252 is connected to the first dome connecting wall 213.

Each second elastic wave assembly 26 includes a second elastic wave fixing part 261, a second elastic wave edge part 262, and a second elastic wave connection part 263 for connecting the second elastic wave fixing part 261 with the second elastic wave edge part 262; the second elastic wave fixing part 261 is fixed on the second frame 12; and the second elastic wave edge part 262 is connected to the second dome connecting wall 223.

Cross sections of the first elastic wave connection part 253 and the second elastic wave connection part 263 along the vibration directions are waved. The waved elastic wave assemblies have higher vibration attenuation performance, which is conductive to improving the stability of vibration of the vibration system 20, thus improving the product performance of the speaker.

In the present embodiment, four first elastic wave assemblies 25 and four second elastic wave assemblies 26 are included and are spaced from one another. Correspondingly, four first dome connecting walls 213 and four second dome connecting walls 214 are included. In other embodiments, the number of the first elastic wave assemblies 25 and the number of the second elastic wave assemblies 26 may also be other numerical values. More preferably, the first elastic wave assemblies 25 and the second elastic wave assemblies 26 are located on the same horizontal plane.

The frame 10 further includes a fixing sheet 13 arranged between the first frame 11 and the second frame 12; part of the first elastic wave assembly 25 is fixed between the first frame 11 and the second frame 12 through the fixing sheet 13. Specifically, two centrosymmetric first elastic wave assemblies 25 include first connecting walls 254 and second connecting walls 255. The first elastic wave edge parts 252 are connected with the first dome connecting wall 213 through the first connecting walls 25, and the first elastic wave fixing parts 251 are bonded with the fixing sheet 13 through the second connecting walls 255, so that the first elastic wave assemblies 25 are fixed between the first frame 11 and the second frame 12. The fixing sheet 13 enhances the connection between the first elastic wave assemblies 25 and the first frame 11 as well as the second frame 12. Similarly, in other embodiments, the second elastic wave assemblies 26 are provided with the above structures, so as to be fixed between the first frame 11 and the second frame 12.

In the present embodiment, the first curved ring 212 includes a ringlike first curved ring main body 2121, a first fixed part 2122 which extends in a bent manner from an outer circumferential side of the first curved ring main body 2121 and is fixed to the first frame 11, and a first connection part 2123 extending in a bent manner from an inner circumferential side of the first curved ring main body 2121; the first dome 211 is fixed to the first connection part 2123; the second curved ring 222 includes a ringlike second curved ring main body 2221, a second fixed part 2222 which extends in a bent manner from an outer circumferential side of the second curved ring main body 2221 and is fixed to the second frame 12, and a second connection part 2223 extending in a bent manner from an inner circumferential side of the second curved ring main body 2221; and the second dome 221 is fixed to the second connection part 2223.

One side of the first dome 211 close to the magnetic circuit system 30 is fitted with several gaskets directly facing a first pole plate 33 and a third pole plate 35 (a bottom wall 352 of the third pole plate).

The first voice coil assembly 23 includes a first voice coil bobbin 231 fixed to the first vibration diaphragm 21 and a first voice coil 232 wound on the first voice coil bobbin 231; the first voice coil 232 is at least partially located in the first magnetic gap 41; the second voice coil assembly 24 includes a second voice coil bobbin 241 fixed to the second vibration diaphragm 22 and a second voice coil 242 wound on the second voice coil bobbin 241; and the second voice coil 242 is at least partially located in the second magnetic gap 42.

The first voice coil 232 is at least partially located in the first magnetic gap 41, and the second voice coil 242 is at least partially located in the second magnetic gap 42, thus generating an electromagnetic field together with the magnetic circuit system 30, which realizes generation of a magnetic drive force and drives the first voice coil 232 and the second voice coil 242 to move in a reciprocating manner, so that the vibration diaphragm 20 vibrates in a reciprocating manner and produces sounds.

The first voice coil bobbin 231 further includes a first leakage hole 233 running through the first voice coil bobbin 231, and the second voice coil bobbin 241 further includes a second leakage hole 243 running through the second voice coil bobbin 241.

The first leakage hole 233 and the second leakage hole 243 are configured for improving the reliability of pressure relief during the vibration of the vibration system 20. More preferably, a plurality of first leakage holes 233 and a plurality of second leakage holes 243 are provided and are disposed at equal intervals, so as to realize pressure relief balance and improve the stability.

Figure 9:
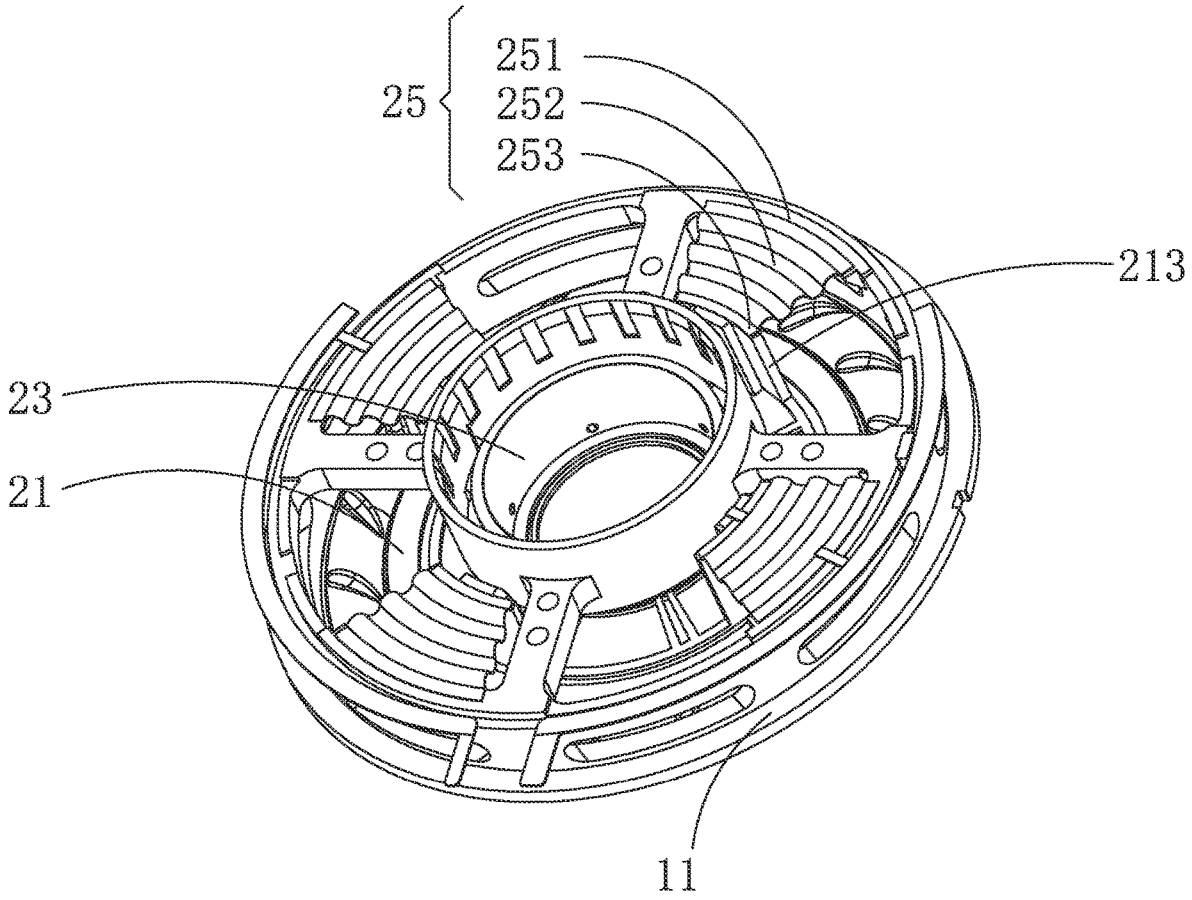
FIG. 9 is a schematic structural diagram of assembling of a first frame and a first vibration system provided by the present invention.
Figure 10:
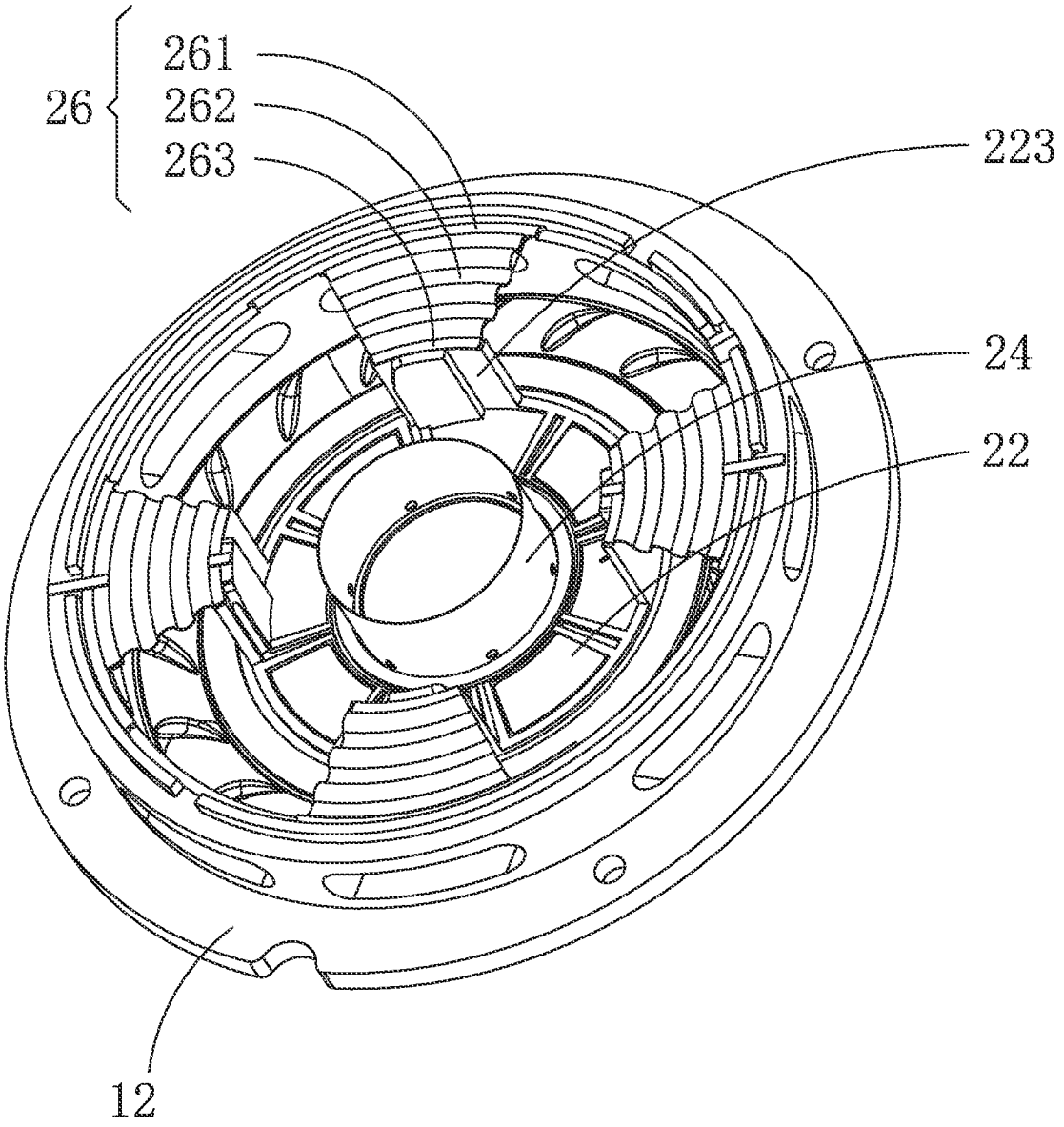
FIG. 10 is a schematic structural diagram of assembling of a second frame and a second vibration system provided by the present invention.

In the speaker of the embodiments of the present invention, referring to FIG. 9 to FIG. 10, in the vibration system 20, a first vibration system is composed of the first vibration diaphragm 21, the first voice coil assembly 23, and the first elastic wave assembly 25; the first vibration system is fixed on the first frame 11; a second vibration system is composed of the second vibration diaphragm 22, the second voice coil assembly 24, and the second elastic wave assembly 26; the second vibration system is fixed on the second frame 12. The first vibration system and the second vibration system may be separately assembled and modularly manufactured.

The embodiments of the present invention are described above only. It should be noted that those of ordinary skill in the art can further make improvements without departing from the concept of the present invention. These improvements shall all fall within the protection scope of the present invention.

What is claimed is:

1. A speaker comprising a frame, a vibration system fixed to the frame, and a magnetic circuit system with a magnetic gap, wherein the vibration system comprises a first vibration diaphragm and a second vibration diaphragm which are fixed to two opposite sides of the frame;

the magnetic circuit system comprises a bobbin which is opened along a vibration direction of the vibration system, a magnet fixed in the bobbin and spaced from an inner wall of the bobbin, a first pole plate fixed on one side of the magnet close to the first vibration diaphragm, a second pole plate fixed to one side of the magnet close to the second vibration diaphragm, and a third pole plate fixed outside the bobbin and spaced from an outer wall of the bobbin; the first pole plate and the third pole plate form a magnetic bowl through the bobbin;

the magnetic gap comprises a first magnetic gap formed by the first pole plate and the third pole plate, and a second magnetic gap formed by the second pole plate and the third pole plate;

the vibration system further comprises a first voice coil assembly inserted into the first magnetic gap to drive the first vibration diaphragm to vibrate and produce sounds, and a second voice coil assembly inserted into the second magnetic gap to drive the second vibration diaphragm to vibrate and produce sounds.

2. The speaker of claim 1, wherein the bobbin comprises a bobbin bottom wall sleeved on an outer circumferential edge of the second pole plate in a spacing manner, a bobbin side wall extending in a bent manner from an inner circumferential edge of the bobbin bottom wall towards the first vibration diaphragm, and a bobbin extending wall which extends in a bent manner from the bobbin side wall towards a direction close to the first pole plate and is parallel to the bobbin bottom wall; and the bobbin extending arm is fixed to one side of the magnet close to the first vibration diaphragm.

3. The speaker of claim 2, wherein the third pole plate comprises a third pole plate side wall sleeved on the outer side of the bobbin side wall in a spacing manner, and a third pole plate bottom wall which extends in a bent manner from the third pole plate side wall towards a direction close to the second pole plate and is parallel to the bobbin bottom wall; and the third pole plate bottom wall is fixed to the bobbin bottom wall.

4. The speaker of claim 3, wherein the bobbin extending arm is fixed to the magnet, the third pole plate bottom wall, and the bobbin bottom wall in a glued, riveted, or welded manner.

5. The speaker of claim 1, wherein the bobbin is made of a magnetically non-conducting material.

6. The speaker of claim 1, wherein the frame comprises a first frame for fixing the first vibration diaphragm and a second frame for fixing the second vibration diaphragm; the first frame is stacked on the second frame along a vibration direction of the vibration system; a mounting part is convexly arranged on one side of the first frame facing the second frame; an avoiding part matched with the mounting part is sunken in a position, corresponding to the mounting part, on the second frame;

or, a mounting part is convexly arranged on one side of the second frame facing the first frame; and an avoiding part matched with the mounting part is sunken in a position, corresponding to the mounting part, on the first frame.

7. The speaker of claim 6, wherein the first frame comprises a frame body, a supporting part spaced from the frame body, and several frame extending arms extending from the frame body to the supporting part; a through hole that runs through the supporting part and fixes the magnetic circuit system is formed in the supporting part along the vibration direction;

or, the second frame comprises a frame body, a supporting part spaced from the frame body, and several frame extending arms extending from the frame body to the supporting part; and a through hole that runs through the supporting part and fixes the magnetic circuit system is formed in the supporting part along the vibration direction.

8. The speaker of claim 1, wherein the first voice coil assembly comprises a first voice coil bobbin fixed to the first vibration diaphragm and a first voice coil wound on the first voice coil bobbin; the first voice coil is at least partially located in the first magnetic gap; the second voice coil assembly comprises a second voice coil bobbin fixed to the second vibration diaphragm and a second voice coil wound on the second voice coil bobbin; and the second voice coil is at least partially located in the second magnetic gap.

9. The speaker of claim 8, wherein the first voice coil bobbin further comprises a first leakage hole running through the first voice coil bobbin, and the second voice coil bobbin further comprises a second leakage hole running through the second voice coil bobbin.

10. The speaker of claim 1, wherein the first vibration diaphragm comprises a first dome located in the center, a first curved ring which surrounds the first dome and is fixed to the frame, and a first dome connecting wall formed by extending from the first dome towards the first voice coil assembly; the second vibration diaphragm comprises a second dome located in the center, a second curved ring which surrounds the second dome and is fixed to the frame, and a second dome connecting wall formed by extending from the second dome towards the second voice coil assembly; the first dome and the first dome connecting wall, and the second dome and the second dome connecting wall are integrated;

the vibration system further comprises a first elastic wave assembly and a second elastic wave assembly which are fixed to the frame and are spaced from each other; one end of the first elastic wave assembly away from the frame is connected to the first dome connecting wall; one end of the second elastic wave assembly away from the frame is connected to the second dome connecting wall; and the first elastic wave assembly and the second elastic wave assembly are in staggered distribution and have antiphase vibration.

* * * * *